US007865116B2

(12) United States Patent
Kawashima

(10) Patent No.: US 7,865,116 B2
(45) Date of Patent: Jan. 4, 2011

(54) ROTARY TYPE DEVELOPING DEVICE

(75) Inventor: Tetsuro Kawashima, Hyogo (JP)

(73) Assignee: Kyocera Mita Corporation, Osaka (JP)

( * ) Notice: Subject to any disclaimer, the term of this patent is extended or adjusted under 35 U.S.C. 154(b) by 1019 days.

(21) Appl. No.: 11/655,066

(22) Filed: Jan. 19, 2007

(65) Prior Publication Data

US 2007/0177900 A1 Aug. 2, 2007

(30) Foreign Application Priority Data

Jan. 31, 2006 (JP) ..... 2006-023309

(51) Int. Cl.
*G03G 15/01* (2006.01)

(52) U.S. Cl. ..... 399/227; 399/119

(58) Field of Classification Search ..... 399/226, 399/227

See application file for complete search history.

(56) References Cited

U.S. PATENT DOCUMENTS 5,168,319 A * 12/1992 Kimura et al. ..... 399/227
2003/0147671 A1* 8/2003 Kishigami ..... 399/227
2004/0057751 A1* 3/2004 Matsuo et al. ..... 399/227

FOREIGN PATENT DOCUMENTS

JP 2005-024575 A 1/2005

* cited by examiner

*Primary Examiner*—David M Gray
*Assistant Examiner*—Roy Yi
(74) *Attorney, Agent, or Firm*—Frommer Lawrence & Haug LLP

(57) ABSTRACT

A color printer 1 has a rotary type developing device 30 which rotated by an input gear 46 that receives power from a motor, and a plurality of developing units 13 supported on a frame 28. The plurality of developing units 13 accommodates toner of different colors therein. The frame 28 a first annular gear 29 being configured to be rotated by the input gear 46 and a second ring-shaped annular member 32 having a larger external diameter than the first annular gear 29. The second ring-shaped annular member 32 is disposed adjacent to and on the outer side of the first annular gear and on the same rotational axis.

16 Claims, 6 Drawing Sheets

ROTARY TYPE DEVELOPING DEVICE

CROSS-REFERENCE TO RELATED APPLICATIONS

This application claims priority to Japanese Patent Application No. 2006-023309 filed on Jan. 31, 2006. The entire disclosure of Japanese Patent Application No. 2006-023309 is hereby incorporated herein by reference.

BACKGROUND OF THE INVENTION

1. Field of the Invention

The present invention generally relates to a rotary type developing device. More specifically, the present invention relates to a rotary type developing device for developing color images.

2. Background Information

Image forming apparatuses capable of forming color images are provided with a plurality of color developing devices each of which internally contains a developer for a respectively different color. There are image forming apparatuses that are provided with rotary developing devices installed on a single frame that allows the plurality of developing devices to rotate as seen in Japanese Laid-Open Patent Publication No. 2005-24575.

When forming a color image in an image forming apparatus provided with rotary type developing devices, the rotary developing devices are rotated and each developing device is sequentially moved to a developing position to develop a respective color. In rotary developing devices of this type, the frame is provided with annular gear members on bilateral ends of the frame in the direction of the axis of rotation. A motor and gear for driving the gear members are arranged in the image forming apparatus. The annular gear member is formed of resin. Therefore, the base and the gear teeth of the rotary developing device come into direct contact when the rotary developing device is being assembled or undergoing maintenance, which may lead to the gear teeth being damaged. When the gear teeth have been damaged, the gear teeth engage poorly and the developing position is shifted out of position. Further, when the developing position is shifted, image quality is reduced.

In view of the above, it will be apparent to those skilled in the art from this disclosure that there exists a need for an improved a rotary type developing device for developing color images. This invention addresses this need in the art as well as other needs, which will become apparent to those skilled in the art from this disclosure.

SUMMARY OF THE INVENTION

An object of the present invention is to prevent the developing position of the rotary developing device from shifting out of position due to poor gear engagement when the rotary developing device is disposed at the developing position.

A rotary developing device according to a first aspect of the present invention provides a rotary type developing device that is rotated by an input gear member that receives a motive force from a drive source provided in a color image forming device, and includes a plurality of containers and a support member. The plurality of containers each respectively accommodates a developer of different color therein. The support member is provided with a support with a rotating shaft that supports the plurality of containers, a first annular gear rotated by the input gear member, and a second ring-shaped annular part which has a larger external diameter than the first annular gear, and which is disposed adjacent to and on the outer side of the first annular gear and on the same rotational axis.

When forming a color image in this rotary developing device, a motive force is transferred from the drive source to the input gear member, such that the support member is rotated via the motive force of the input gear member. The plurality of containers develops an image via the developers of respective colors as the support member rotates. A color image is developed when the support member has completed one rotation. When this rotary developing device is placed on a base while being assembled or while performing maintenance and the like, the gear teeth of the rotary developing device must come into contact the second annular member without directly contacting the base or the like. Thus, in this device, damage to the gear teeth can be prevented even when the rotary developing device is placed on a base.

A rotary developing device according to a second aspect of the present invention is the rotary developing device of the first aspect, wherein the second annular part has a notch having a predetermined width.

In this case, the rotary developing device is moved in the axial direction to engage the gear of the input member when the image forming apparatus is being assembled. The gear part of the input gear is easily assembled due to the notch provided on a part of the second annular member.

A rotary developing device according to a third aspect of the present invention is the rotary developing device of the second aspect, wherein the predetermined width is equal to the width of three gear teeth of the first annular gear.

A rotary developing device according to a fourth aspect of the present invention is the rotary developing device of the third aspect, wherein a mark is provided at the position at which the input gear member engages the notch of the second annular member. Thus, during the assembly of the image forming apparatus, the input gear member and first annular gear can be engaged at a precise position.

A rotary developing device according to a fifth aspect of the present invention is the rotary developing device of the fourth aspect, wherein the mark on the input gear member is a protuberance. Thus, during the assembly of the image forming apparatus, the input gear member and first annular gear can be engaged at a precise position via a simple structure.

A rotary developing device according to a sixth aspect of the present invention is the rotary developing device of the first aspect, wherein the support member has four flat plates and a pair of discs provided at the bilateral ends of the four flat plates in the axial direction.

A rotary developing device according to a seventh aspect of the present invention is the rotary developing device of the first aspect, wherein the first annular gear is disposed on the outer side of the disk in the direction of rotation.

A rotary developing device according to an eighth aspect of the present invention is the rotary developing device of the first aspect, wherein the second annular part is an annular part that extends beyond the outer circumference end of the gear teeth of the first annular gear at the end of the second annular member in the axial direction.

A rotary developing device according to a ninth aspect of the present invention is the rotary developing device of the first aspect, wherein the second annular part is disposed adjacent to and on the outer side of the first annular gear and on the same rotational axis.

One result of the present invention is that it prevents the developing position of the rotary developing device from shifting out of position due to poor engagement of gears when the rotary developing device is disposed at the developing position.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
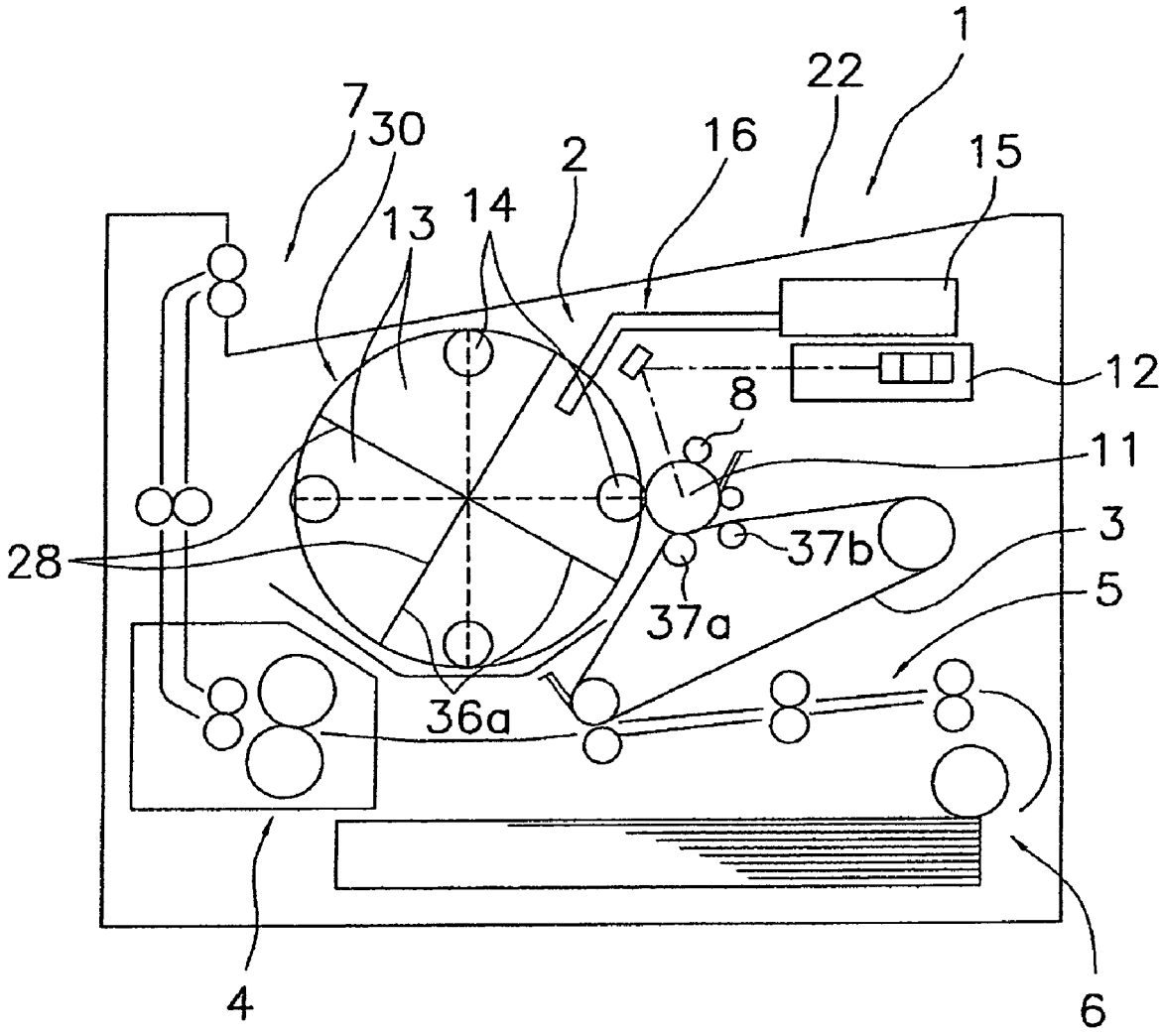
FIG. 1 is a schematic cross-sectional view of a color printer in accordance with a first preferred embodiment of the present invention.

FIG. 1 is a schematic cross-sectional view of a color printer 1, which is an image forming apparatus, in accordance with a preferred embodiment of the present invention. FIG. 1 is a schematic view that indicates the layout of each of the structural elements, with the details of some the structural elements omitted.

The color printer 1 is preferably connected to a computer or the like, which is not shown in the drawing, and is an apparatus used to print a color image on a paper sheet based on image information transmitted from the computer.

The color printer 1 is provided with an image forming unit 2 to form a toner image based on image information, an intermediate transfer belt 3 to transfer the image formed by the image forming unit 2, a fixing unit to fix the toner image formed by the image forming unit 2 on the paper sheet, a sheet transporting unit 5 to transport the sheet to the image forming unit 2 or the like, a paper supplying unit 6 to supply paper to the sheet transporting unit 5, a discharge unit 7 to discharge sheets bearing the fixed toner image, and a toner replenishing unit 22 to re-supply toner to the image forming unit 2.

The image forming unit 2 is a part that forms toner images and is provided with a photosensitive drum 11 on the surface of which an electrostatic latent image is formed, a rotary type developing device 30 to form a toner image, a laser unit 12 to scan optically the surface of the photosensitive drum 11 based on image information, and a drive unit 45 to drive the rotary developing device 30.

The photosensitive drum 11 is provided to be adjacent to four developing units 13, and the rotating shaft is further arranged so as to extend perpendicular to the surface of the paper sheet of FIG. 1. A charging roller 8 that uniformly charges the surface of the photosensitive drum 11 is provided above the photosensitive drum 11.

The rotary developing device 30 includes four developing units 13 that respectively contain toner (developers) of one of four colors that include yellow, cyan, magenta, and black, a frame 28 (support member) to support the four developing units 13, and an annular support member 33 to support part of the frame 28. The developing device 30 rotates upon a rotating shaft 40 as a rotational center. The four developing units 13 (containers) are components that develop a toner image, and are configured as four equal parts of a cylinder in the circumference direction. Furthermore, each developing unit 13 has a built-in developing roller 14, and each developing roller 14 supplies toner to the photosensitive drum 11. The four developing units 13 are supported by the frame 28.

Figure 2:
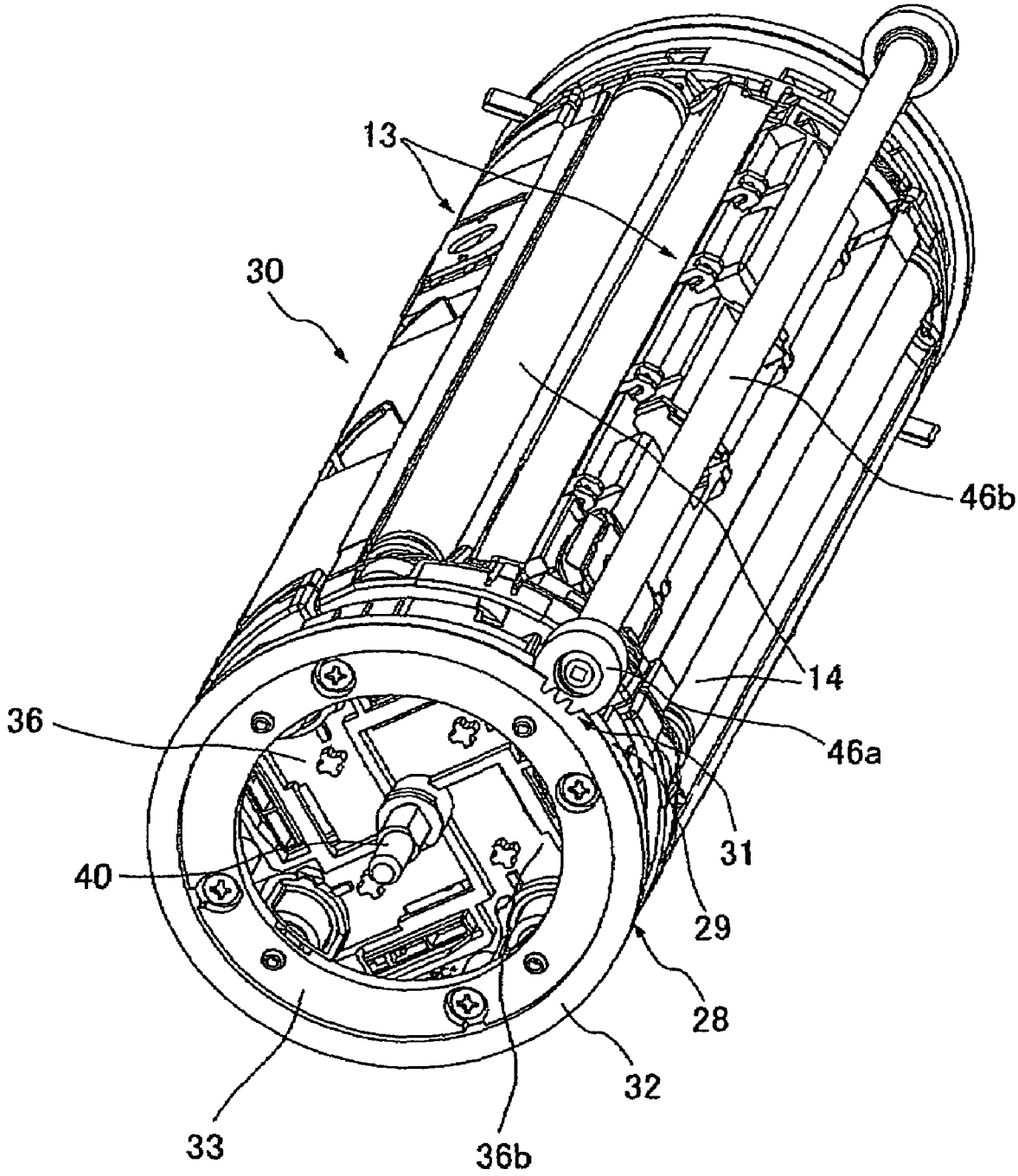
FIG. 2 is a perspective view of a rotary developing device of the color printer of FIG. 1.
Figure 3:
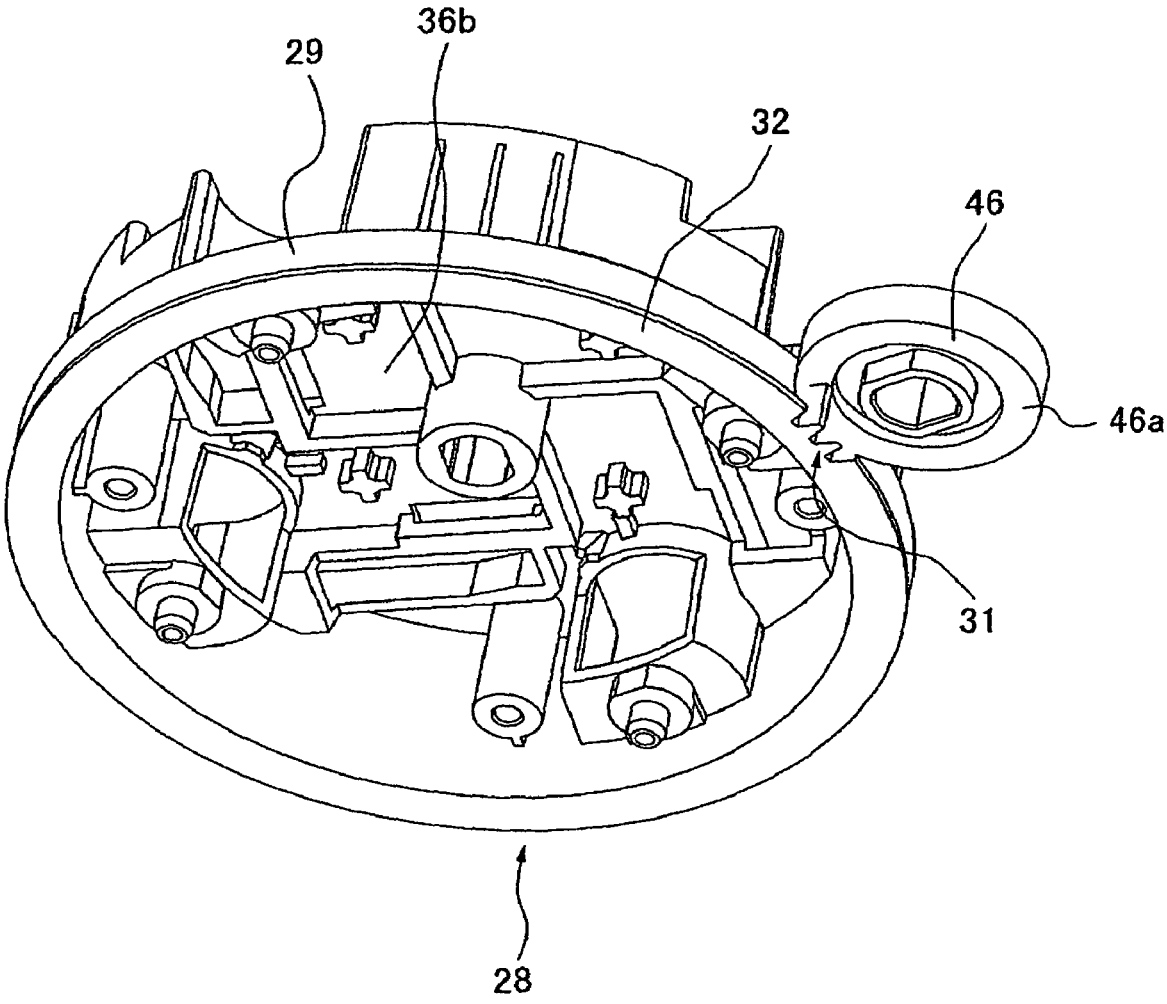
FIG. 3 is perspective view of a part of the rotary developing device and an input gear of the color printer of FIG. 1.
Figure 4:
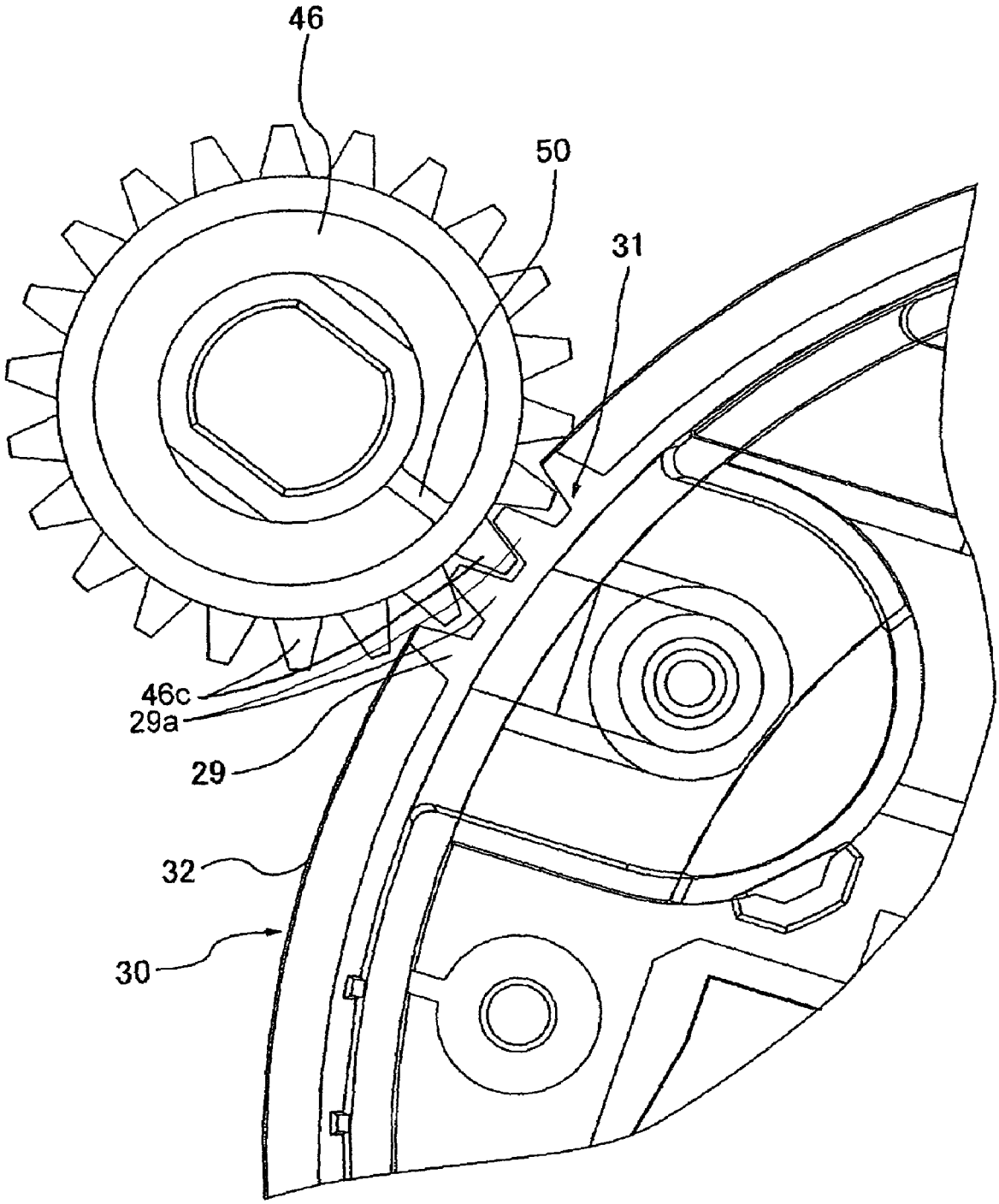
FIG. 4 is an enlarged view of part of the rotary developing device and the input gear.
Figure 6:
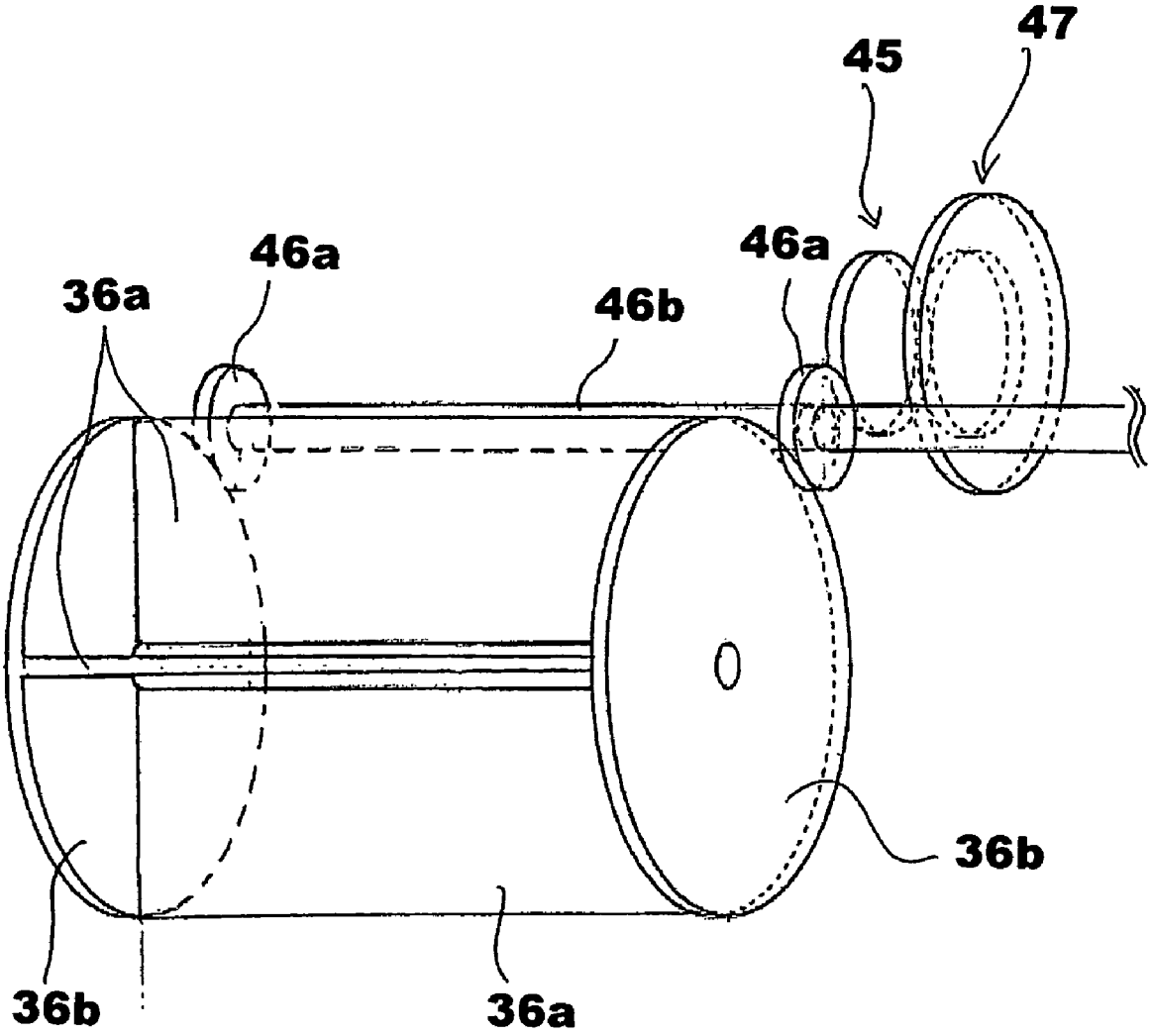
FIG. 6 is perspective view of a part of the support part and the drive part of the color printer of FIG. 1.

As shown in FIG. 2, the frame 28 (support member) supports the four developing units 13, and has a support part 36 to support the four developing units 13, an annular gear 29 (first annular gear) provided at bilateral sides in the direction of the support part 36, and an annular rib 32 (second annular member) provided on the annular gear 29. The support part 36 is configured by four flat plates 36*a* (refer to FIG. 1 and FIG. 6), and a pair of disks 36*b* (refer to FIG. 6), disposed at bilateral ends of the four flat plates 36*a* in the axial direction. The four flat plates 36*a* extend radially from the rotating shaft 40, and form four equal sections in the circumferential direction. Furthermore, the disks 36*b*, which are identical in size, are respectively disposed at the bilateral ends of the rotating shaft 40. The annular gear 29 has a ring shape and is disposed on the outer side of the disk 36*b* in the direction of the rotating shaft 40. The annular gear 29 has gear teeth 29*a* (not all of which are necessarily shown in the drawings) formed on the outer circumference, as shown in FIGS. 3 and 4, so as to be capable of engaging the input gear 46 of the drive part 45, which is described later. It should be understood that the gear teeth 29*a* can be around the entire outer circumference of the annular gear 29. As shown in FIGS. 2 and 3, the annular rib 32 is disposed on the outer side of and adjacent to the annular gear 29 on the same axis in the direction of the rotating shaft 40. The annular rib 32 preferably contacts the annular gear 29. This annular rib 32 is a ring-shaped part extending beyond the end of the gear teeth 29*a* of the annular gear 29 in the axis direction Furthermore, the annular rib 32 has a notch 31 cut so that the remaining part of the annular rib 32 overlaps the gear teeth 29*a* of the annular gear 29. This notch 31 preferably has a width of three gear teeth 29*a* of the annular gear 29.

As shown in FIG. 2, the annular support member 33 is an annular plate that supports the annular gear 29 from the inner circumference side of the support part 36 of the frame 28. The annular support member 33 is fixed by screws to the disk 36*b* of the support part 36 in a configuration concentric with the annular gear 29, and the outer circumference side contacts the inner circumference side of the annular gear 29.

The laser unit 12 irradiates the photosensitive drum 11 with laser light.

Figure 5:
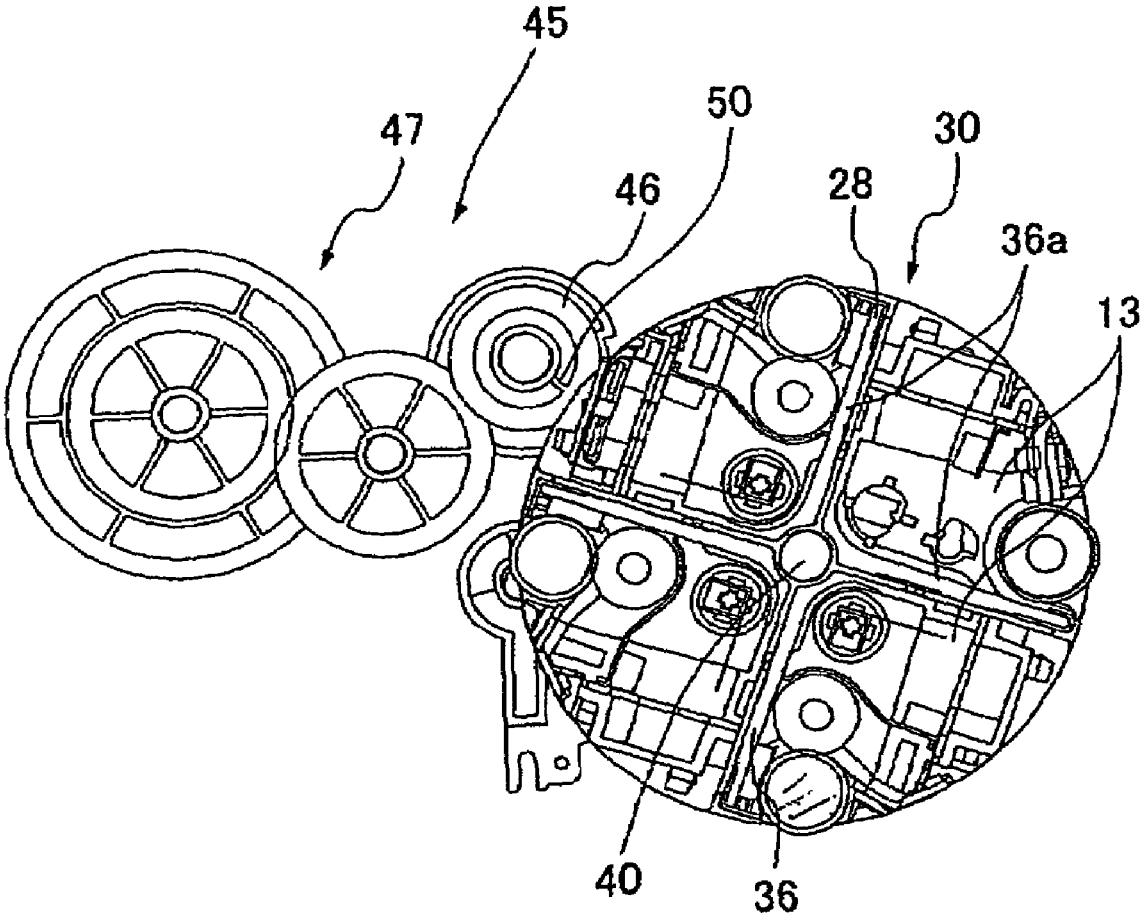
FIG. 5 is a cross-sectional view of the rotary developing device and a drive unit of the color printer.

As shown in FIG. 5, the drive unit 45 rotates the rotary developing device 30, and is provided with an input gear 46, a gear train 47 to rotate the input gear, and a motor (not shown in the drawing) that is connected to the gear train. As seen in FIG. 2, the input gear 46 is configured by a pair of disk-shaped members 46*a* that have a smaller external diameter than the annular gear 29, and a shaft member 46*b* that connects the pair of disk-shaped members 46*a*. Referring to FIGS. 3 and 5, each of pair of disk members 46*a* has gear teeth 46*c* that engage the gear on the external circumference of the annular gear 29. A protrusion 50 is provided as a mark at an optimum position for the mutual engagement of the gear teeth 29*a* of the annular gear 29 and the gear teeth 46*c* of the input gear 46. As seen in FIG. 2, the shaft member 46*b* is a rod-like member disposed parallel to the rotating shaft 40 of the rotary developing device 30. As seen in FIG. 5, the gear train 47 is configured by a plurality of gears that transfers the motive force of the motor to the input gear 46. The motor generates a motive force to rotate the rotary developing device 30, and is connected to the gear train 47.

As seen in FIG. 1, the intermediate transfer belt 3 sequentially transfers the toner image of each color formed on the photosensitive drum 11, and the intermediate transfer belt 3 is looped between a drive roller and a driven roller that is forced laterally by a spring to be separated from the drive roller. The part of the intermediate transfer belt 3 that is facing the photosensitive drum 11 is configured to come into contact with the photosensitive drum 11 via a pair of primary transfer rollers 37*a* and 37*b*.

The fixing device 4 fixes the image formed by the image forming unit 2 onto a paper sheet, and is provided with a heating roller and a pressure roller.

The sheet transporting unit 5 transports a sheet to the image forming unit 2 and fixing device 4, and is provided with a transport path that extends from the paper supply unit 6 to the discharge unit 7.

The paper supply unit 6 has a paper cassette that contains paper for printing, and rollers and the like to feed the paper to the sheet transport path 5.

The discharge unit 7 discharges a sheet bearing a fixed image through the sheet transport path 5, and is disposed on the top surface of the color printer 1.

The toner replenishing unit 22 is provided with a toner reservoir 15 that internally contains replenishing toner, and a toner supplying device 16 that supplies the toner from the toner reservoir 15 to the developing units 13. The toner reservoir 15 has four aligned box-like containers and each respectively accommodates a color toner.

The toner supplying device 16 supplies toner to the developing units 13, and has a toner supplying pipe. When toner is re-supplied, the toner supplying pipe is moved to re-supply toner into the developing unit 13.

Operation

In the color printer 1, image data are received from an externally connected computer or the like, and a toner image is formed by the image forming unit 2 based on the image data. Specifically, an electrostatic latent image is formed on the photosensitive drum 11 based on the image data, and the rotary developing device 30 is rotated to a developing position at which a toner image of one color can be developed. When the toner image of one color is developed on the photosensitive drum 11, the rotary developing device 30 is thereafter rotated 90 degrees to a position at which a toner image of a second color can be developed. Thus, four color toner images are sequentially developed to form a full color toner image. At this time, a sheet of paper is transported to the image forming unit 2 by the sheet transporting unit 5, and the color image is transferred to this sheet. Thereafter, the sheet bearing the transferred color image is transported to the fixing device 4, the color image is fixed on the sheet and the sheet is ejected from the discharge unit 7. Thus, the sheet bearing a color image based on the image data received from a computer or the like is discharged.

As seen in FIG. 2, although vibration is generated in conjunction with the rotation while the rotary developing device 30 is rotating, bending of the annular gear 29 is prevented because the inner circumference of the annular gear 29 of the frame 28 is supported by the annular support member 33.

When the color printer 1 is being assembled or maintenance is being performed, the input gear 46 and the like that drives the rotary developing device 30 are installed beforehand inside the external frame of the color printer 1, and the rotary developing device 30, which is placed on a base or the like, is inserted in the rotational axis direction with the position aligned with the position of the protrusion 50 to engage the input gear 46. Specifically, the rotary developing device 30 is inserted from the foreground side of the drawing to the background side of the drawing of FIG. 1 to engage the gear teeth 29*a* of the annular gear 29 and the gear teeth 46*c* of the input gear 46.

At this time, the gear teeth 29*a* of the annular gear 29 do not come into contact with the base or the like even though the rotary developing device 30 is placed on the base for the installation of the annular member 32 in the rotary developing device 30. Furthermore, the rotary developing device 30 is easily installed so as to engage the input gear 46 since the annular member 32 is provided with the notch 31.

Other Embodiment

Although the notch 31 provided on the annular member 32 is formed with the same width as three gear teeth in the above embodiment, the present invention is not limited to this width inasmuch as the width may also be larger.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device equipped with the present invention. Accordingly, these terms, as utilized to describe the present invention should be interpreted relative to an image forming device equipped with the present invention as used in the normal riding position. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rotary type developing device that receives a force from an input gear member that is rotated by gear train that receives a motive force from a drive source provided in a color image forming device, the rotary developing device comprising:

a plurality of containers being configured to accommodate respectively and internally developers of different colors; and a support member including a support having a rotating shaft being configured to support said plurality of containers, a first annular gear being configured to be rotated by the input gear member, and a second ring-shaped annular member having a larger external diameter than said first annular gear, and being disposed adjacent to and on the outer side of said first annular gear and on the same rotational axis;

wherein said second annular member has a notch having a predetermined width of three gear teeth of said first annular gear.

2. The rotary type developing device according to claim 1 wherein said notch is positioned in a region in the circumferential direction on a part of an exterior circumference of said second annular member.

3. The rotary type developing device according to claim 2, wherein the input gear member is provided with a mark at a position at which the notch of said second annular member is engaged.

4. The rotary type developing device according to claim 3, wherein said mark of the input gear member is a protrusion.

5. The rotary type developing device according to claim 1, wherein said support member has four flat plates, and a pair of disks provided at the bilateral ends of said four flat plates in the axial direction.

6. The rotary type developing device according to claim 1, wherein said first annular gear is radially disposed on the outside of said disks.

7. The rotary type developing device according to claim 1, wherein said second annular member is a ring-like part that extends to the outer circumference side in the axial direction beyond the end of said gear teeth of said first gear.

8. The rotary type developing device according to claim 1, wherein said second annular part is disposed adjacent to and on the outer side of said first annular gear and on the same rotational axis.

9. An image forming apparatus comprising:

an image support member having a surface, an electrostatic latent image being configured to be formed thereon;

a gear train;

an input gear member having a plurality of teeth being configured to be rotated by said gear train; and rotary type developing device being configured to receive a force from said input gear and being arranged to supply toner to said photosensitive drum, said rotary type developing device having a plurality of containers being configured to accommodate respectively and internally developers of different colors, and a support member including a support having a rotating shaft being configured to support said plurality of containers, a first annular gear being configured to be rotated by said input gear member, and a second ring-shaped annular member having a larger external diameter than said first annular gear, and being disposed adjacent to and on the outer side of said first annular gear and on the same rotational axis;

wherein said second annular member has a notch having a predetermined width of three gear teeth of said first annular gear.

10. The image forming apparatus according to claim 9, wherein said notch is positioned in a region in the circumferential direction on a part of an exterior circumference of said second annular member.

11. The image forming apparatus according to claim 9, wherein said input gear member is provided with a mark at a position at which the notch of said second annular member is engaged.

12. The image forming apparatus according to claim 11, wherein said mark of said input gear member is a protrusion.

13. The image forming apparatus according to claim 9, wherein said support member has four flat plates, and a pair of disks provided at the bilateral ends of said four flat plates in the axial direction.

14. The image forming apparatus according to claim 9, wherein said first annular gear is radially disposed on the outside of said disks.

15. The image forming apparatus according to claim 9, wherein said second annular member is a ring-like part that extends to the outer circumference side in the axial direction beyond the end of said gear teeth of said first gear.

16. The image forming apparatus according to claim 9, wherein said second annular part is disposed adjacent to and on the outer side of said first annular gear and on the same rotational axis.

* * * * *